US005983855A

United States Patent [19]

Benedikt et al.

[11] Patent Number: 5,983,855

[45] Date of Patent: Nov. 16, 1999

[54] FUEL INJECTION VALVE WITH INTEGRATED SPARK PLUG

[75] Inventors: Walter Benedikt, Kornwestheim; Franz Rieger, Schwieberdingen; Rainer Norgauer, Ludwigsburg; Christian Preussner, Markgröningen, all of Germany

[73] Assignee: Robert Bosch GmbH, Stuttgart, Germany

[21] Appl. No.: 09/068,373

[22] PCT Filed: Aug. 11, 1997

[86] PCT No.: PCT/DE97/01704

§ 371 Date: May 7, 1998

§ 102(e) Date: May 7, 1998

[87] PCT Pub. No.: WO98/12431

PCT Pub. Date: Mar. 26, 1998

[30] Foreign Application Priority Data

Sep. 18, 1996 [DE] Germany ..... 196 38 025

[51] Int. Cl.[6] ..... F02P 23/02

[52] U.S. Cl. ..... 123/297

[58] Field of Search ..... 123/297

[56] References Cited

U.S. PATENT DOCUMENTS 2,459,286 1/1949 Rabezzana et al. .

2,795,214 6/1957 Shook, II ..... 123/297

4,095,580 6/1978 Murray et al. ..... 123/297

4,343,272 8/1982 Buck ..... 123/297

5,497,744 3/1996 Nagaosa et al. ..... 123/297

FOREIGN PATENT DOCUMENTS 0 632 198 1/1995 European Pat. Off. .

0 661 446 7/1995 European Pat. Off. .

*Primary Examiner*—John Kwon

*Attorney, Agent, or Firm*—Kenyon Kenyon

[57] ABSTRACT

A fuel injection valve includes a valve needle passing through the valve opening to the valve closing body arranged on the spray outlet end. A closing spring prestresses the valve needle in a direction opposite its opening direction aimed in the direction of spraying, so that the valve closing body is in contact with the valve seat on the spray outlet end when the fuel injection valve is closed. The armature is kept engaged and in contact with the valve needle by means of a bearing spring which acts in the direction of opening by means of a connecting piece arranged between the armature and the valve needle. The connecting piece includes a suitable insulation element for providing insulation against high voltage.

11 Claims, 2 Drawing Sheets

FUEL INJECTION VALVE WITH INTEGRATED SPARK PLUG

FIELD OF THE INVENTION

The present invention relates to a fuel injection valve with an integrated spark plug.

BACKGROUND INFORMATION

European Patent Application No. 0 661 446 descibes a fuel injection valve with an integrated spark plug for direct injection of fuel into a combustion chamber of an internal combustion engine and igniting the fuel injected into the combustion chamber. The fuel injection valve includes a valve body having a valve opening surrounded by a valve seat on the spray outlet end and sealed by a valve closing body when the solenoid is not energized, the closing body being is arranged on a valve needle extending through the interior of the valve body. The valve needle can be operated electromagnetically by means of a solenoid acting on an armature to open the fuel injection valve. The valve seat and the valve closing body are arranged on the inside of the valve opening on the inlet end, and the valve body is shaped on the spray outlet end into a central starting electrode surrounded by a pot-type counter-electrode. High voltage is supplied from the end of the fuel injection valve opposite the spray outlet end to the central starting electrode over the valve body, the valve needle and an axial extension which is connected to the valve needle over a restoring spring. The armature surrounds the inlet end of the valve needle in a ring and is insulated from the valve needle by an insulation body. Fuel is delivered through an outer ring channel opening into the inlet end of the valve body.

A disadvantage of this conventional fuel injection valve with an integrated spark plug is that the insulation body arranged between the armature and the valve body is exposed to tensile stress when the fuel injection valve is opened, and therefore a corresponding form-fitting connection between the armature and the insulation body on the one hand and the insulation body and the valve needle on the other hand must be provided.

Furthermore, the insulation body has a relatively complex shape in order to surround the valve needle and the restoring spring on all sides outside the valve body to insulate them. Since ceramic materials, which are relatively brittle and therefore are difficult to process, are generally used for high-voltage insulation, it is relatively expensive to produce the relatively complex shape of the insulation body provided between the armature and the valve needle and the other insulation body needed for high-voltage insulation. Furthermore, ceramic materials have a tendency to show premature fatigue when exposed to tensile stress for extended periods.

Another fuel injection valve with an integrated spark plug is described in European Patent Application No. 0 632 198. With this conventional fuel injection valve, electric insulation is not provided between the valve needle and the armature connected to the valve needle or between the armature and a magnet core that is opposite the armature and can be energized by a solenoid. Instead, an insulation body arranged between the valve body and the casing is lengthened so that it surrounds the magnet core radially toward the solenoid and thus prevents a high-voltage sparkover to the solenoid. However, this design does not permit the development of a closed magnetic flux circuit of ferromagnetic material. Therefore, relatively high solenoid currents are needed to operate the fuel injection valve to adequately magnetize the magnet core passing through the solenoid.

SUMMARY OF THE INVENTION

The fuel injection valve according to the present invention with an integrated spark plug is advantageous in that insulation element arranged between the armature and the valve needle is subjected only to pressure during operation of the fuel injection valve. Since the fuel injection valve is designed as a valve opening to the outside, the valve needle is acted on by pressure but not with tensile stress to open the fuel injection valve, so the insulation element arranged between the armature and the valve needle is subjected to pressure but not tensile stress. Therefore, the insulation element may have a relatively simple design, in particular a cylindrical or cuboid shape, so that complicated processing is not necessary in the manufacture of the insulation element, which is preferably made of a ceramic material. There is no need for a form-fitting connection of the insulation element to the valve needle, such as that which would be necessary with tensile stress on the insulation element and the valve needle. To transmit the compressive stress exerted by the armature over the insulation element on the valve needle for opening the fuel injection valve, it is sufficient for the insulation element to have a friction fit on the valve needle. This is achieved using a bearing spring which holds the armature in engaged with the valve needle over a connecting piece containing the insulation element.

The fuel injection valve according to the present invention is also advantageous in that the valve needle responds immediately after the solenoid is energized due to the tight engagement of the armature with the valve needle. This permits rapid opening which is advantageous for precise metering of fuel and allows a very accurate control of the time of injection. Furthermore, this yields the additional advantage that only the relatively small inert mass of the valve needle strikes the valve seat when the fuel injection valve is closed, because the connecting piece connecting the valve needle to the armature is lifted briefly away from the valve needle in closing the fuel injection valve and is brought to a standstill not by the valve seat but by the bearing spring. This reduces the wear on the valve seat and in the valve closing body.

The valve body can also be insulated with respect to the casing by a one-piece insulation body radially surrounding the valve body. The inlet end of the valve body may be insulated with respect to the elements of magnetic actuation, in particular the solenoid, by a section of the insulation body projecting beyond the valve body at this end. An axial borehole surrounding the insulation element may be provided in the section of the insulation body projecting beyond the valve body, thus yielding complete insulation of the valve body on the inlet and outlet ends due to the combination of the insulation body with the insulation element. With a lateral high-voltage feed for the starting electrode of the valve body insulated in this manner, this yields an advantage of complete axial separation and insulation of the high-voltage-carrying elements from the elements of magnetic actuation of the fuel injection valve.

The initial stress of the bearing spring can be adjustable by means of an adjustable spring-adjusting bushing. This yields an advantage that the closing force exerted by the closing spring and the bearing force exerted by the bearing spring in the direction of opening can be adjusted to one another so that the coil current required to energize the solenoid in opening the fuel injection valve is minimized while at the same reliable closing of the fuel injection valve is ensured.

DETAILED DESCRIPTION OF THE DRAWINGS

Figure 1:
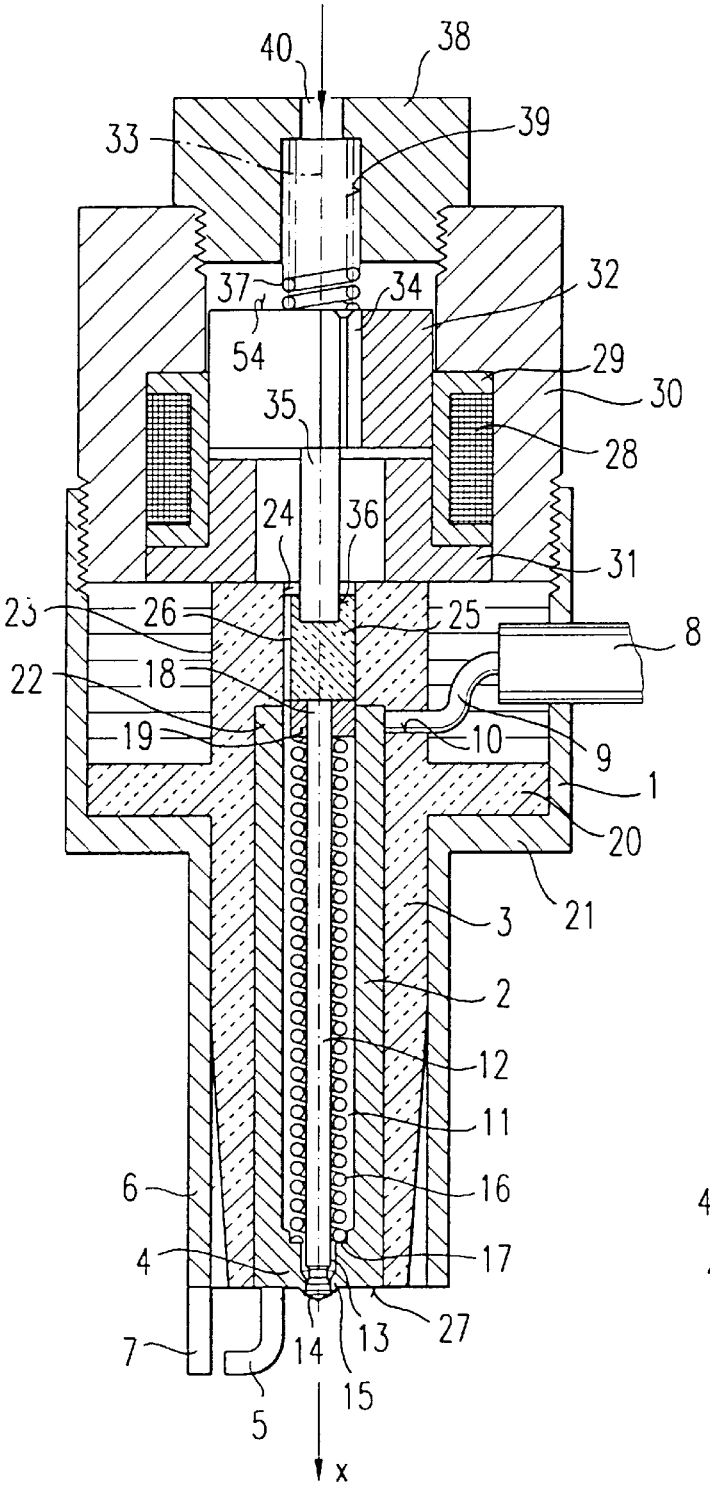
FIG. 1 shows a section through a fuel injection valve of a first embodiment according to the present invention with an integrated spark plug.

The fuel injection valve with an integrated spark plug shown in FIG. 1 for direct injection of fuel into a combustion chamber of an internal combustion engine with mixture compression and external ignition and for ignition of the fuel injected into the combustion chamber has a casing 1 made of an electrically conducting material, in particular a metal. In the interior of casing 1 is also arranged a tubular valve body 2 made of an electrically conducting material, in particular a metal. The valve body being insulated with respect to casing 1 by a high-voltage insulating insulation body 3. Insulation body 3 is preferably made of a ceramic material and can withstand the igniting voltage required for igniting the fuel.

Valve body 2 has a first starting electrode 5 on its spray outlet end 4 which is bent in this embodiment and is opposite a second starting electrode 7 arranged on the spray outlet end 6 of casing 1, so that the two electrodes work together to produce a spark discharge which ignites the fuel injected into the combustion chamber. Thus, starting electrodes 5 and 7 are connected to a high-voltage source (not shown) over a high-voltage cable 8 and over an ignition controller (not shown). A high-voltage lead 9, designed as an extension of high-voltage cable 8, passes through a connecting hole 10 in insulation body 3 and is in contact with valve body 2. The contact between high-voltage lead 9 and valve body 2 can be accomplished in a conventional manner by pinching, soldering, or the like. A ground lead of high-voltage cable 8 is electrically contacted on casing 1 in a suitable manner, so that the igniting voltage carried by high-voltage cable 8 is applied between starting electrodes 5 and 7 and is discharged there in the form of a spark discharge in a conventional manner. The fuel injection valve is designed as a fuel injection valve opening toward the outside. A valve needle 12 passes through a valve opening 13 provided on the spray outlet end 4 of valve body 2 in a longitudinal axial bore 11 in valve body 2. Valve needle 12 is enlarged at the spray outlet 4 of valve opening 13 to form valve closing body 14 which works together with a valve seat 15 surrounding valve opening 13 on the spray outlet end to form a tight seating.

A closing spring 16 is provided to prestress valve needle 12 against spray outlet opening x of the fuel injection valve and thus close the fuel injection valve. Closing spring 16 is arranged in the longitudinal bore 11 of valve body 2 in this embodiment and extends parallel to its longitudinal axis, surrounding valve needle 12. Closing spring 16 is clamped between spray outlet end 17 of longitudinal bore 11 of valve body 2 and a valve needle bushing 19 connected to inlet end 18 of valve needle 12. In assembling valve body 2 with valve needle 12, restoring spring 16 and valve needle bushing 19, first valve needle 12 is passed from the spray outlet end through valve opening 13 and then restoring spring 16 is pushed onto valve needle 12 before valve needle bushing 19 is placed on valve needle 12 and attached thereto by welding, soldering, or the like. In attaching valve needle bushing 19 to valve needle 12, restoring spring 16 is prestressed so that valve closing body 14 arranged on valve needle 12 is in contact with valve seat 15 with sufficient closing force so that the fuel injection valve is reliably closed.

Insulation body 3 has a peripheral collar 20 which engages behind an end plate 21 of casing 1 to lock insulation body 3 in the axial direction. Insulation body 3 projects beyond inlet end 22 of valve body 2 by a guide section 23 which has a preferably cylindrical bore 24 into which a preferably cylindrical insulation element 25 can be inserted, preferably coaxially with valve needle 12, so that insulation element 25 can be moved in the axial direction and is guided by guide section 23 in the process. To direct fuel through bore 24 in guide section 23 of insulation body 3 into longitudinal bore 11 of valve body 2 connected to bore 24, the diameter of bore 24 may be dimensioned slightly smaller than the diameter of bore 24 in guide section 23 of insulation body 3, so that an annular gap remains between the inside surface of bore 24 and the outside surface of insulation element 25, permitting fuel to flow through. As an alternative or in addition, the insulation element may have axial grooves 26 or bores which direct fuel past insulation element 25 or through insulation element 25.

High-voltage-carrying valve body 2 is insulated on all sides, except for its spray outlet end face 27, by insulation body 3 in combination with insulation element 25. This reliably prevents high-voltage sparkover to casing 1 or to other electrically conducting parts of the fuel injection valve.

The fuel injection valve is conventionally actuated by a solenoid 28. Solenoid 28 is connected to an injection controller (not shown) by a connecting line (not shown). The winding of solenoid 28 is on a winding carrier 29 and is partially surrounded by a first magnetic conducting element 30 on the outside and a second magnetic conducting element 31 connected to the first magnetic conducting element 30. Conducting elements 30 and 31, made of a ferromagnetic material, together with cylindrical armature 32, also made of a ferromagnetic material, form a closed magnetic flux circuit. Armature 32 is movable with respect to longitudinal axis 33 of the fuel injection valve and is pulled in the direction of the second magnetic conducting element 31 when current is applied to solenoid 28. To permit fuel to flow through armature 32, it has at least one axial bore 34. As an alternative, however, armature 32 could also have peripheral grooves, or a corresponding annular gap could be provided between armature 32 and the first magnetic conducting element 30, which controls armature 32, and winding carrier 29. Armature 32 is connected to insulation element 25 by a pin 35 which engages in a blind hole 36 in insulation element 25.

According to the present invention, armature 32 is kept engaged and in contact with valve needle 12 by means of a bearing spring 37 acting in the direction of opening of the fuel injection valve over a connecting piece including pin 35 and insulation element 25. Bearing spring 37 which is in contact with inlet end face 54 of armature 32 is supported on connecting block 38 on the inlet end and is guided in it in a stepped bore 39 which is tapered toward a fuel inlet connection 40 at the inlet end. Connecting block 38 is connected to the first magnetic conducting element 30, e.g., by a screw connection.

When solenoid 28 is not energized, valve closing body 14 arranged on valve needle 12 is pressed against valve seat 15 by closing spring 16 on the spray outlet end, thus closing the fuel injection valve. When current is applied to solenoid 28, a magnetic flux flows in the magnetic flux circuit formed by the first magnetic conducting element 30, the second magnetic conducting element 31 and armature 32, pressing armature 32 in the direction of the second magnetic conducting element 31. Thus, a mechanical pressure acts on valve needle 12 over pin 35 and insulation element 25 in the direction of opening, i.e., in the spray outlet direction x, thus lifting valve closing body 14 away from valve seat 15 and opening the fuel injection valve. Since armature 32 continues to be kept in contact and engagement with valve needle 12 over pin 35 and insulation element 25 by means of bearing spring 37, the movement of needle 12 directly follows the movement of armature 32, so the fuel injection valve responds immediately after current is applied to solenoid 28. Therefore, a force-fitting connection between armature 32 and valve needle 12 is achieved by bearing spring 37 without requiring a form-fitting connection between insulation element 25 and valve needle 12 on the one hand and between insulation element 25 and pin 35 on the other hand. Insulation element 25 can therefore be designed in an extremely simple manner, e.g., with a cylindrical shape, which greatly simplifies the production of insulation element 25, which is preferably made of a ceramic material and is therefore relatively brittle.

After switching off the electric current energizing solenoid 28, the fuel injection valve is closed again by closing spring 16 by bringing valve closing body 14 to rest against valve seat 15. This yields another advantage of the contact, non-form-fitting connection between insulation element 25 and valve needle 12, because the relatively small inert mass of valve needle 12 must be brought to a standstill by valve closing body 14 coming to rest against valve seat 15. Insulation element 25 may be lifted up briefly from the inlet end 18 of valve needle 12, so the much larger inert mass of armature 32, pin 35 and insulation element 25 in comparison with valve needle 12 is brought to a standstill due to deformation of bearing spring 37. Bearing spring 37 then presses armature 32 and the connecting piece including pin 35 and insulation element 25 back in the direction of valve needle 12 until insulation element 25 is again in contact with valve needle 12. Since only the relatively small mass of valve needle 12 strikes valve seat 15, wear on valve seat 15 is minimized. The low stress on valve seat 15 and valve closing body 14 is especially important with a fuel injection valve which injects directly into the combustion chamber of the combustion engine, because valve seat 15 and valve closing body 14 are subjected to high thermal stresses by being arranged in or near the combustion chamber.

Bearing spring 37 may be designed relatively weak in comparison with closing spring 16, because it has only the function of braking the armature 32, pin 35 and insulation element 25 in closing the fuel injection valve and transmitting a bearing pressure to keep armature 32 engaged in contact with valve needle 12 by way of the connecting piece including pin 35 and insulation element 25.

Since insulation element 25 is subjected only to pressure but not tensile stress when the fuel injection valve is actuated, no special demands are made of the tensile strength of insulation element 25, which is preferably made of a ceramic material.

The components serving to provide electromagnetic actuation of the fuel injection valve are completely insulated from high, voltage-carrying valve body 2 by means of insulation body 3 and insulation element 25, thus effectively preventing high-voltage sparkover to these components, which greatly improves the operating reliability of the improved fuel injection valve according to the present invention.

Figure 2:
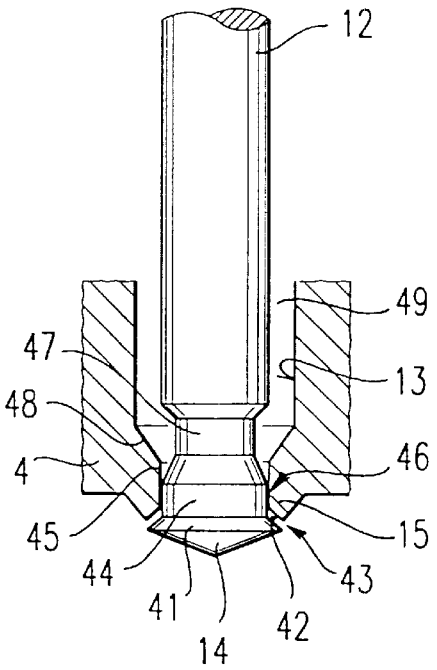
FIG. 2 shows an enlarged diagram of an area of a valve seat of the embodiment illustrated in FIG. 1.

FIG. 2 shows an enlarged diagram of a preferred embodiment of valve needle 12 and valve closing body 14 in the area of valve opening 13 provided on the spray outlet end 4 of valve body 3.

Valve needle 12 extends through valve opening 13 and has valve closing body 14 on its spray outlet end. Valve closing body 14 includes a truncated conical section 41 which is opposite a truncated conical valve seating face 42 on valve seat 15. Therefore, an annular gap 43 which determines the spray cone angle of the fuel jet is formed between truncated conical section 41 of valve closing body 14 and truncated conical valve seating face 42 of valve seat 15 in opening the fuel injection valve. Upstream from valve closing body 14, valve needle 12 has a cylindrical metering section 44 which is guided in a cylindrical section 45 of valve opening 13. Between the inside surface of the cylindrical section 45 of valve opening 13 and the outside surface of metering section 44 of valve needle 12 there is a narrow cylindrical annular gap 46 which serves as a fuel metering gap when the fuel injection valve is opened.

It is advantageous that the throttling set on cylindrical annular gap 46 for the fuel metering is practically independent of the stroke, and annular gap 43 which serves as the spray outlet opening can be relatively large in dimension without affecting fuel metering, thus greatly reducing the risk of a fuel injection valve not closing due to particles of dirt trapped between valve closing body 14 and valve seat 15.

Upstream from cylindrical metering section 44, the valve needle has a tapered section 47. Valve opening 13 tapers in the direction of flow from a section 49 with an enlarged diameter to cylindrical section 45 described above in a truncated conical section 48 opposite tapered section 47 of valve needle 12.

A number of alternative embodiments of valve needle 12, valve opening 13, valve closing body 14 and valve seat 15 are of course conceivable within the scope of the present invention. With regard to the intended compression stress on valve needle 12 for opening the fuel injection valve, it is essential only for the fuel injection valve to be designed as a valve opening toward the outside, where valve closing body 14 is in contact with valve seat 15 on the spray outlet end.

Figure 3:
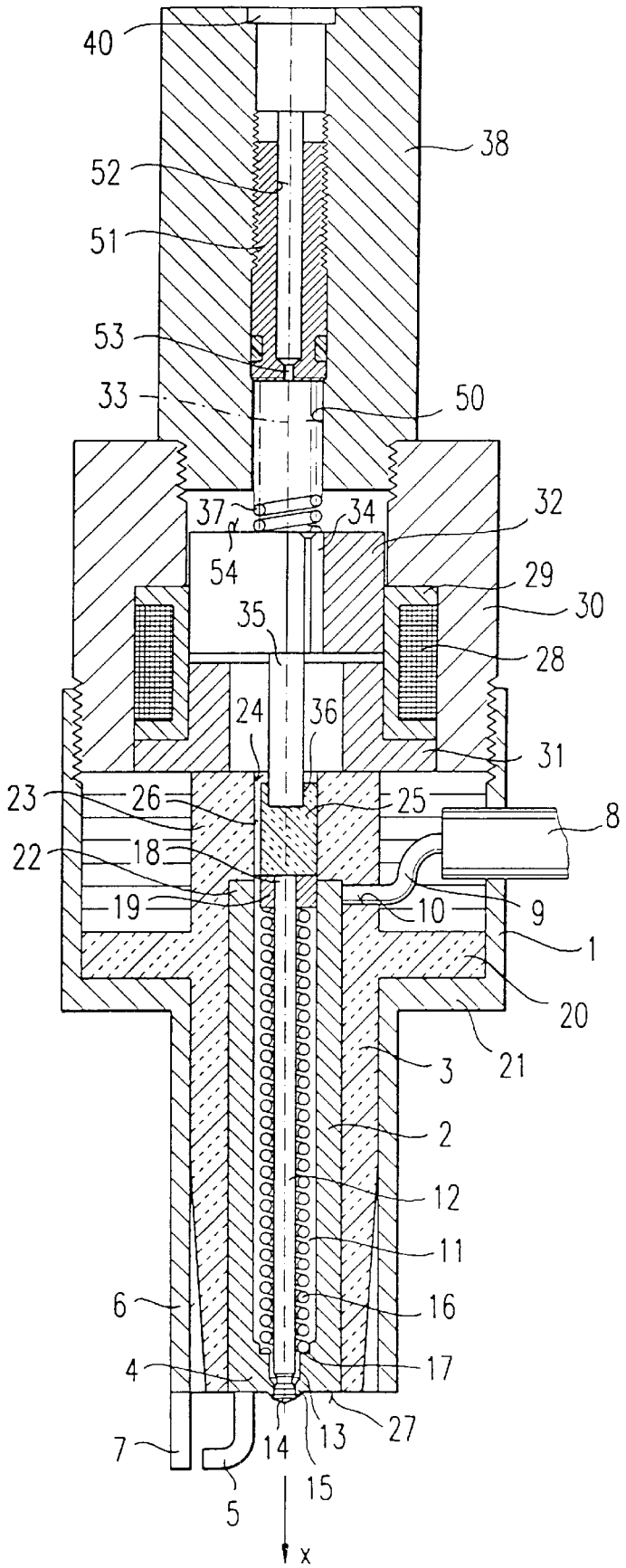
FIG. 3 shows a section through the fuel injection valve of a second embodiment according to the present invention.

FIG. 3 shows a further embodiment of the fuel injection valve according to the present invention with an integrated spark plug. The components described above are provided with the same notation, so no further description is necessary in this regard.

Connecting block 38 is enlarged at the inlet end toward fuel inlet connection 40 in comparison with the embodiment illustrated in FIG. 1. A longitudinal bore 50 into which bearing spring 37 is inserted is provided in connecting block 38. As illustrated in FIG. 3, an adjustable spring-adjusting bushing 51 is provided in longitudinal bore 50 of connecting block 38, whose position in longitudinal bore 50 is adjustable by means of a thread, for example. For the adjustment, spring-adjusting bushing 51 is accessible from fuel inlet connection 40. Spring-adjusting bushing 51 has an axial longitudinal bore 52 which opens into longitudinal bore 50 of connecting block 38 over a throttle 53.

The initial tension of bearing spring 37 can be adjusted by means of spring-adjusting bushing 51 so that, after each opening of the fuel injection valve, armature 32 can be rapidly brought into contact and engagement with inlet end 18 of valve needle 12 by means of the connecting piece including pin 35 and insulation element 25. Furthermore, the fuel injection valve remains reliably closed due to the resulting force difference between the spring force of closing spring 16 acting in the direction of closing and the spring force of bearing spring 37 acting in the direction of opening without solenoid 28 being energized. Therefore, the spring force exerted by bearing spring 37 is smaller than the spring force exerted by closing spring 16. Through an appropriate choice of the pre-tension exerted by bearing spring 37 on armature 32, the coil current of solenoid 28 needed to open the fuel injection valve can also be minimized.

What is claimed is:

1. A fuel injection valve having an integrated spark plug for directly injecting fuel into a combustion chamber of an internal combustion engine and for igniting the injected fuel, the fuel injection valve comprising:

a valve seat;

a first starting electrode;

a valve body having a valve opening, the valve opening being surrounded, at a spray outlet end, by the valve seat and by the first starting electrode formed on the valve body;

a second starting electrode insulated from the valve body by a high-voltage insulation, the second starting electrode cooperating with the first starting electrode to generate a spark discharge, the spark discharge igniting the injected fuel;

a valve needle;

a valve closing member provided on the valve needle for closing the valve opening, the valve needle extending through the valve opening to the valve closing member at the spray outlet end;

a closing spring providing an initial tension on the valve needle in a closing direction of the valve needle, the initial tension being provided in the closing direction for biasing the valve closing member to rest against the spray outlet end of the valve seat when the fuel injection valve is closed;

an armature;

a solenoid acting on the armature to open the fuel injection valve by electromagnetically actuating the valve needle;

a connecting member situated between the armature and the valve needle and including a high-voltage-insulating insulation element; and a bearing spring maintaining the armature in engaged contact with the valve needle by generating a further tension in an opening direction along the connecting member.

2. The fuel injection valve according to claim 1, wherein the valve body is radially surrounded, with respect to a longitudinal axis of the fuel injection valve, by a high-voltage-insulating insulation member, the high-voltage-insulating insulation member being surrounded by an electrically conducting casing, and wherein the second starting electrode is situated at the spray outlet end.

3. The fuel injection valve according to claim 2, further comprising:

a high-voltage lead extending through the high-voltage-insulating insulation member in a radial direction with respect to the longitudinal axis of the fuel injection valve, the high-voltage lead being coupled to the valve body.

4. The fuel injection valve according to claim 2, wherein the valve body has an inlet end facing away from the valve opening, and wherein the high-voltage-insulating insulation member includes a guide section extending beyond the inlet end of the valve body, the high-voltage-insulating insulation member having an axial bore surrounding the high-voltage-insulating insulation element to movably guide the high-voltage-insulating insulation element in the axial bore.

5. The fuel injection valve according to claim 1, wherein the valve needle extends substantially over a full length of the valve body accommodating the valve needle, wherein the valve needle has an inlet end facing away from the valve closing member, and wherein the high-voltage-insulating insulation element flushly contacts the inlet end of the valve needle in response to the further tension of the bearing spring.

6. The fuel injection valve according to claim 5, wherein the closing spring is situated in an interior portion of the valve body, the closing spring surrounding the valve needle and being clamped between an outlet end of the valve body and the inlet end of the valve needle.

7. The fuel injection valve according to claim 1, wherein the high-voltage-insulating insulation element has a matching recess, and wherein the connecting member includes a pin-shaped element situated between the armature and the high-voltage-insulating insulation element, the connecting member being inserted into the matching recess.

8. The fuel injection valve according to claim 7, wherein the armature, the pin-shaped element, the high-voltage-insulating insulation element and the valve needle are axially symmetrical and are arranged coaxially with one another.

9. The fuel injection valve according to claim 1, wherein the bearing spring acts on an end face of the armature, the end face facing away from the connecting member.

10. The fuel injection valve according to claim 9, further comprising:

an adjustable spring-adjusting bushing supporting the bearing spring.

11. The fuel injection valve according to claim 1, wherein the valve needle has a cylindrical metering section upstream from the valve closing member, the cylindrical metering section being surrounded by a cylindrical section of the valve opening to form a cylindrical annular gap between an external surface of the cylindrical metering section and an internal surface of the cylindrical section for forming a metering cross section.

* * * * *

UNITED STATES PATENT AND TRADEMARK OFFICE

CERTIFICATE OF CORRECTION

PATENT NO. : 5,983,855
DATED : November 16, 1999
INVENTOR(S) : Walter Benedikt, et al.

It is certified that error appears in the above-identified patent and that said Letters Patent is hereby corrected as shown below:

Abstract [57], lines 8 and 10, change (two occurrences) "means" to - - virtue - -;

Column 1, line 16, change ", the" to - - . The - -;

Column 2, line 2, after "that" insert - - the - -;

Column 2, line 39, change "in" to - - on - -;

Column 3, line 38, after "manner." - - (new paragraph) The fuel.....- -;

Column 3, line 43, after "outlet" insert - - end - -; and

Column 5, line 4, after "of" insert - - valve - -.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*